US010421021B2

(12) United States Patent
Smith et al.

(10) Patent No.: US 10,421,021 B2
(45) Date of Patent: Sep. 24, 2019

(54) ROLLER COASTER VEHICLE GUIDANCE SYSTEM INCLUDING A SIDE GUIDE ASSEMBLY WITH WHEEL SUSPENSION

(71) Applicant: DISNEY ENTERPRISES, INC., Burbank, CA (US)

(72) Inventors: John D. Smith, Orlando, FL (US); Brooke M. Swift, Winter Garden, FL (US); Felicia D. Hight, Orlando, FL (US); Brecken L. Kanz, Orlando, FL (US); Anthony R. Defilippo, Merrit Island, FL (US); Marc A. Medina, Bradenton, FL (US); Alejandro A. Figueroa, Orlando, FL (US)

(73) Assignee: DISNEY ENTERPRISES, INC., Burbank, CA (US)

( * ) Notice: Subject to any disclaimer, the term of this patent is extended or adjusted under 35 U.S.C. 154(b) by 385 days.

(21) Appl. No.: 15/585,740

(22) Filed: May 3, 2017

(65) Prior Publication Data

US 2018/0318722 A1 Nov. 8, 2018

(51) Int. Cl.
*A63G 7/00* (2006.01)

(52) U.S. Cl.
CPC ..... *A63G 7/00* (2013.01)

(58) Field of Classification Search
CPC ..... A63G 7/00
USPC ..... 104/53
See application file for complete search history.

(56) References Cited

U.S. PATENT DOCUMENTS 3,204,944 A 9/1965 Brownyer
3,841,225 A * 10/1974 Johnson ..... B61L 23/005 104/130.01
4,724,771 A 2/1988 Yamada
4,794,865 A * 1/1989 Lindberg ..... A63G 7/00 104/109
4,831,937 A 5/1989 Yamada
(Continued)

FOREIGN PATENT DOCUMENTS

FR 2815908 A1 5/2002
GB 731304 A 6/1955
WO 2015003863 A1 1/2015

OTHER PUBLICATIONS http://www.coaster101.com/2011/10/24/coasters-101-wheel-design/.

(Continued)

*Primary Examiner* — Jason C Smith

(74) *Attorney, Agent, or Firm* — Marsh Fischmann & Breyfogle LLP; Kent A. Lembke

(57) ABSTRACT

A system for providing guidance of a ride vehicle on a track of a park ride, e.g., a vehicle or car of a roller coaster, that is adapted to provide side guide wheel suspension with a design that requires significantly less maintenance than the traditional pin and bushing configuration. The system includes a side guide assembly includes two spring members, which may each take the form of a leaf spring, that are directly mounted to the main support of the bogie assembly (e.g., the load wheel assembly, the up stop assembly, and the support frame of the bogie assembly). The spring members are adapted to provide anchor points for the side guide wheel shafts that each side guide wheel is mounted onto for rotation. When the spring members are leaf springs, the eyes of each leaf spring may form the anchor points or shaft supports for the wheel rotation shafts.

19 Claims, 9 Drawing Sheets

(56) References Cited

U.S. PATENT DOCUMENTS

| | | | | |
|---|---|---|---|---|
| 5,595,121 | A * | 1/1997 | Elliott | A63G 7/00 104/288 |
| 5,685,227 | A | 11/1997 | Gaccetta et al. | |
| 6,047,645 | A | 4/2000 | Cornwell et al. | |
| 6,093,266 | A | 7/2000 | Mollee | |
| 6,158,354 | A * | 12/2000 | Eiraku | A63G 7/00 104/53 |
| 6,504,648 | B2 | 1/2003 | Mauro | |
| 6,523,479 | B1 * | 2/2003 | Schilke | A63G 7/00 104/57 |
| 7,640,862 | B2 * | 1/2010 | Zamperla | A63G 7/00 104/53 |
| 8,590,455 | B2 * | 11/2013 | Schilke | A63G 7/00 104/53 |
| 9,272,224 | B2 | 3/2016 | Nemeth et al. | |
| 2011/0017092 | A1 * | 1/2011 | Beutler | A63G 7/00 104/53 |
| 2016/0052526 | A1 * | 2/2016 | Slurink | B61B 13/04 104/93 |
| 2016/0159181 | A1 | 6/2016 | Hahn et al. | |
| 2016/0207369 | A1 | 7/2016 | Krahn et al. | |
| 2018/0318722 | A1 * | 11/2018 | Smith | A63G 7/00 |

OTHER PUBLICATIONS

For the Reocrd, 2017, http://ftr.wot-news.com/2013/08/01/p-2640-italys-tinest-tank-of-ww2/.

Extended European Search Report for EP Application No. 18162278.8, dated Sep. 25, 2018.

* cited by examiner

ROLLER COASTER VEHICLE GUIDANCE SYSTEM INCLUDING A SIDE GUIDE ASSEMBLY WITH WHEEL SUSPENSION

BACKGROUND

1. Field of the Description

The present description relates, in general, to track-based amusement and theme park rides including roller coasters and to suspensions for ride vehicles. More particularly, the description relates to a system for providing guidance of a ride vehicle (e.g., a roller coaster vehicle or car) along a track, and the vehicle's guidance system includes a side guide assembly configured to provide suspension for the side guide wheels.

2. Relevant Background

The roller coaster is one of the more common and popular amusement and theme park rides for providing a thrilling ride experience. In a typical roller coaster, the cars or vehicles are not self powered, but, instead, a train of vehicles supported upon a track is pulled up a ramp or lift hill with a chain or cable to a peak of the coaster track. The potential energy accumulated by the rise in height is transferred to kinetic energy as the vehicles are released or dropped and race down the downward slope. Kinetic energy is then converted back to potential energy as the vehicle train moves up again to a second peak after which it then falls at rapid speed. This cycle is repeated throughout the ride until the vehicle train returns to the loading/unloading station.

The roller coaster vehicle is typically guided on the track using two or more guidance mechanisms or assembles that each have three sets or pairs of wheels. Particularly, a traditional guidance mechanism includes load wheels that are coupled to the passenger compartment (such as through a chassis) and ride upon the upper surface of the track. The traditional guidance mechanism also includes up stop wheels that ride on or near the lower surface of the track and limit or stop upward movement of the roller coaster vehicle relative to the track. The guidance mechanism further includes side guide wheels that ride on or near the side surfaces of the track and act to guide the load and the up stop wheels to follow or remain in contact with the track.

Original roller coaster designs had vehicles with no suspensions, and the passengers experienced less comfortable rides. Recent advances in the guidance of roller coaster vehicles include the addition of suspension systems within the guidance mechanisms that allow some movement of the wheels to reduce shock loading of the system which may increase comfort of the passengers. Existing suspension designs use a bracket with a bushing and a pin, and the suspension typically includes one or more spring members such as a rubber block or a coil spring.

For example, FIG. 1 illustrates a traditional guidance mechanism 110 that is used to guide a ride vehicle, such as a roller coaster car, along the track 104, and a ride vehicle typically would include two to four or more of the guidance mechanisms 110 attached to its passenger compartment (such as via a chassis). The guidance mechanism 110 includes a load wheel assembly 112 with a pair of load wheels 113 that are positioned to ride upon the top surface of the track 104 and carry the load of the vehicle during ride operations. The guidance mechanism 110 further includes the up stop assembly 116 coupled to the load wheel assembly 112 via a structural frame or bracket 114, and the up stop assembly 116 includes an up stop wheel 117 that is positioned to ride on or near the lower surface of the track 104 to limit or stop the mechanism 110 and the vehicle it is attached to from lifting off or away from the track 104.

Further, the guidance mechanism 110 includes a side guide assembly 120 that is also coupled to the load wheel assembly 110 via the structural bracket 114, and the side guide wheel assembly 120 includes a pair of side guide wheels 121. The side guide assembly 120 functions to guide (along with other another guidance mechanism on the opposite side of the vehicle) the ride vehicle along the track 104 and/or to retain the load wheels 113 on the upper surface of the track 104. The side guide assembly 120 is configured to provide suspension for the vehicle by allowing the wheels 121 to move as shown with arrows 122, 123 relative to the track 104 in a direction that is transverse or even orthogonal to the track's surfaces.

FIG. 2 illustrates an exploded side view of the side guide assembly 120 that is useful for explaining how suspension of the mechanism 110 is typically achieved. As shown (with reference to one side of the symmetric assembly 120), the side guide assembly 120 includes a side guide wheel 121 that is supported, to be able to rotate about its rotation axis, through the use of a side guide wheel pin 130 that passes through the wheel 121 and is supported upon the side guide bracket 132. The side guide bracket 132 is, in turn, attached to the structural frame or bracket 114 of the guidance mechanism 110.

Suspension is achieved in part by pivotally coupling the side guide bracket 132 to the structural frame/bracket 114 via a pivot pin 134 that is fitted via a pair of bushings 138 to upper and lower pin blocks 136, 137, which are affixed to the structural frame/bracket 114. The suspension is further facilitated by providing a spring member 142 that is attached, via shim 144 and support block 140, to the structural frame/bracket 114 of the guidance mechanism 110. The spring member 142 often takes the form of a block or pad of elastomer material such as a rubber and is sandwiched between the support block 140 and a mating surface of the side guide bracket 132 to limit and cushion movement of the side guide wheel 121 relative to the track 104.

The suspension provided with the guidance mechanism 110 is effective and useful in many park rides and is used in many roller coasters. However, the pin and bushing design can require significant maintenance and frequent part replacement due to a combination of shock loading, which occurs frequently in normal use (e.g., numerous daily uses of a roller coaster). Particularly, the pivot pin 134 and bushings 138 are high wear items that may wear to a point that they need to be periodically replaced. For example, the pin 134 wears down to a smaller diameter over time while the inner diameter of the bushings may increase undesirably in size, and this type of wear may make the pivoting motion needed for proper suspension more difficult. These are both relatively expensive components, and it can be time consuming to inspect these parts for wear (e.g., measuring the outer diameter of the pin 134) and to replace worn parts (e.g., disassembly of the guidance mechanism 110).

SUMMARY

The inventors recognized a need for a new mechanism or system for providing guidance of a ride vehicle on a track of a park ride, e.g., a vehicle or car of a roller coaster, and the present description provides a vehicle guidance system that is adapted to provide side guide wheel suspension with a design that requires significantly less maintenance than the traditional pin and bushing configuration. In the vehicle guidance system, the pin and bushing joint is completely removed and replaced with a spring-based design.

The side guide assembly of the new guidance system may include two spring members, which may each take the form of a leaf spring (or set of leaf springs), that are directly mounted to the main support of the bogie assembly (e.g., the load wheel assembly, the up stop assembly, and the structural or frame bracket (i.e., the main support of the bogie assembly)). The spring members are adapted to provide anchor points for the side guide wheel shafts that each side guide wheel is mounted onto for rotation. When the spring members are leaf springs, the eyes of each leaf spring may form the anchor points or shaft supports for the wheel rotation shafts. In some embodiments, two leaf springs are arranged to be parallel and spaced apart (e.g., a distance that is large enough to allow the side guide wheels to be positioned between the leaf springs) and are used to provide at their ends (e.g., via their eyes) supports for two wheel rotation shafts.

The new guidance system allows for the required articulation of the side guide wheels while eliminating undesirable wear as seen on traditional pin and bushing guidance mechanisms. In the new guidance system, as the side guide wheels contact the track, the spring members, which may be leaf springs, are allowed to deflect to the desired amount for a particular ride with its particular track and vehicle configuration based on the stiffness and design of the spring member. It is believed that the guidance system is adaptable to various rides and attractions to provide specific articulation characteristics.

More particularly, an apparatus is provided for guiding a roller coaster along a track with suspension (which may be labeled a vehicle guidance system herein). The apparatus includes a load wheel assembly for rollably engaging an upper surface of the track and an up stop assembly for contacting a lower surface of the track opposite the upper surface. The apparatus also includes a main support frame coupling the load assembly to the up stop assembly. Further, the apparatus includes a side guide assembly rigidly attached to the main support frame, and the side guide assembly includes a pair of side guide wheels for rollably engaging a side surface of the track (e.g., the outer surface of the track between the load wheel assembly and the up stop assembly). The side guide assembly further includes a rotation shaft extending through a center of each of the wheels and an elongated spring element extending from a first end to a second end. The first and second ends each includes an eye (e.g., a tie hole) receiving and supporting one of the rotation shafts.

In some embodiments, the side guide assembly further includes a second elongated spring element spaced apart from the elongated spring element, and the second elongated spring element includes first and second ends each including an eye receiving and supporting one of the rotation shafts. In these embodiments, the elongated spring element is parallel to the second elongated spring element, and longitudinal axes of the rotation shafts are orthogonal to the elongate spring element and the second elongated spring element.

In some preferred implementations, the elongated spring element include a leaf spring. In such implementations, the eyes are defined by surfaces of ends of at least one leaf of the leaf spring. In some cases, the side guide assembly further includes a bushing inserted into each of the eyes of the leaf spring. Further, some embodiments may use a leaf spring with a single leaf while others use one or two leaf springs that each includes a plurality of leaves.

In these or other embodiments, the side guide assembly includes a mounting plate and a set of fasteners for rigidly affixing a center portion of the spring element to the main support frame. In such embodiments, the side guide assembly further includes a shim stack of adjustable thickness positioned between the mounting plate and the main support frame.

DETAILED DESCRIPTION

The following description is generally directed to providing suspension for an amusement or theme park ride, such as a roller coaster. Specifically, a vehicle guidance system is provided that includes one or more spring members, such as leaf springs, in the side guide assembly. The spring members are coupled to the main support or structural bracket of the system's bogie assembly (i.e., the load wheel assembly, the up stop assembly, and the main support or structural bracket), and the spring members are arranged to extend parallel to the longitudinal axis of the track when installed and, significantly, to provide support members at each end. These support members are used to provide anchor points for the rotation shafts of the side guide wheels.

In the past, guidance mechanisms typically utilized a pin and bushing design, and the pins and bushings were susceptible to wear. Attempts to improve wear included changing the bushing and pin materials, which increased the cost of these parts, and/or by adding lubrication. This has created some improvements but has not wholly resolved the maintenance issued issues associated with prior guidance mechanisms, and cost sensitive ride designers often utilize ride guidance mechanisms for their roller coasters and other rides that have no suspension, which leads to a rougher ride and, in some cases, rider discomfort. The guidance system described herein removes the pivot joint with its pin and bushings, and this eliminates the associated maintenance challenges while retaining the improved ride comfort associated with side guide wheel suspension. The design of the guidance system has been proven through prototyping to provide: (1) reduced weight; (2) reduced manufacturing costs; and (3) reduced maintenance costs by eliminating pins and bushings that can be subjected to wear.

Figure 1:
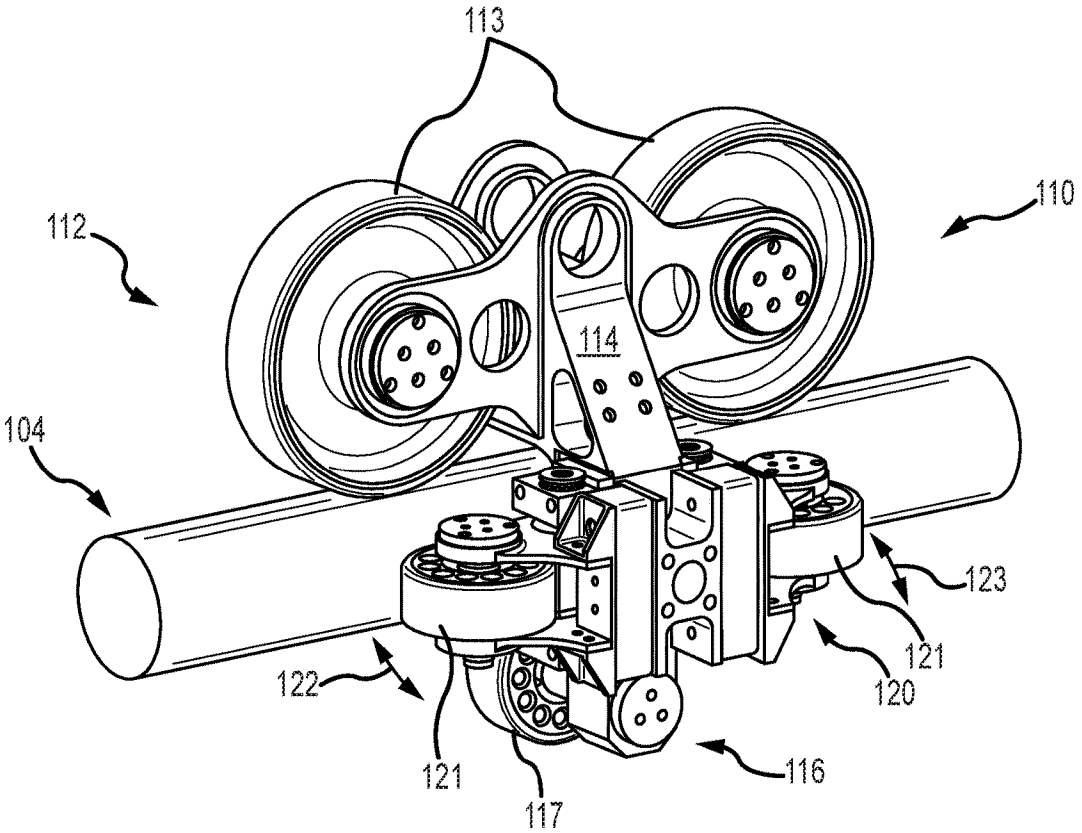
FIG. 1 PRIOR ART
FIG. 1 is a perspective view of a traditional guidance mechanism as would be attached to a ride vehicle to guide the ride vehicle along a section of track in a ride such as a roller coaster.
Figure 2:
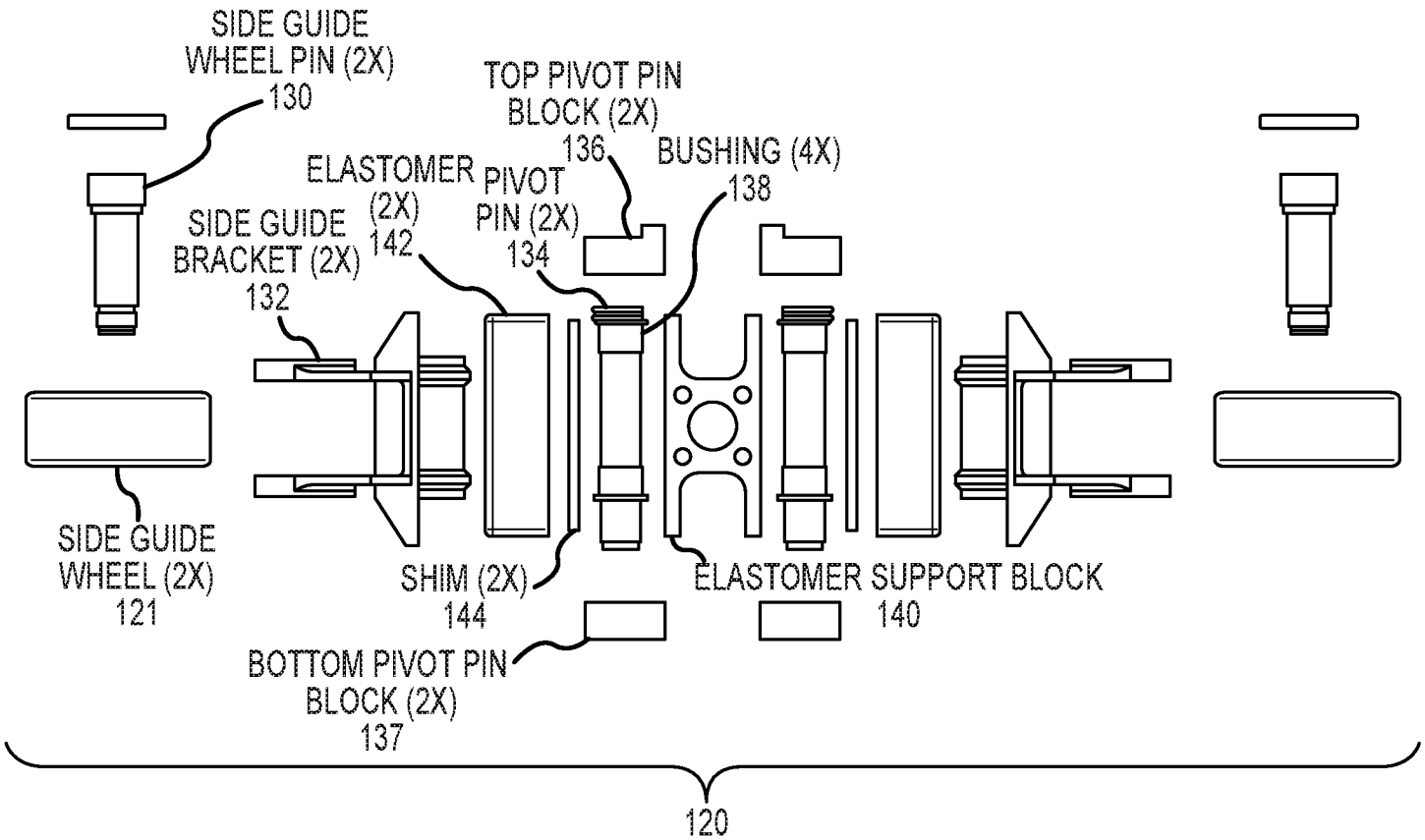
FIG.2 PRIOR ART
FIG. 2 is side exploded view of the side guide assembly of the traditional guidance mechanism of FIG. 1 showing a pin and bushing design that is combined with an elastomer pad.
Figure 3:
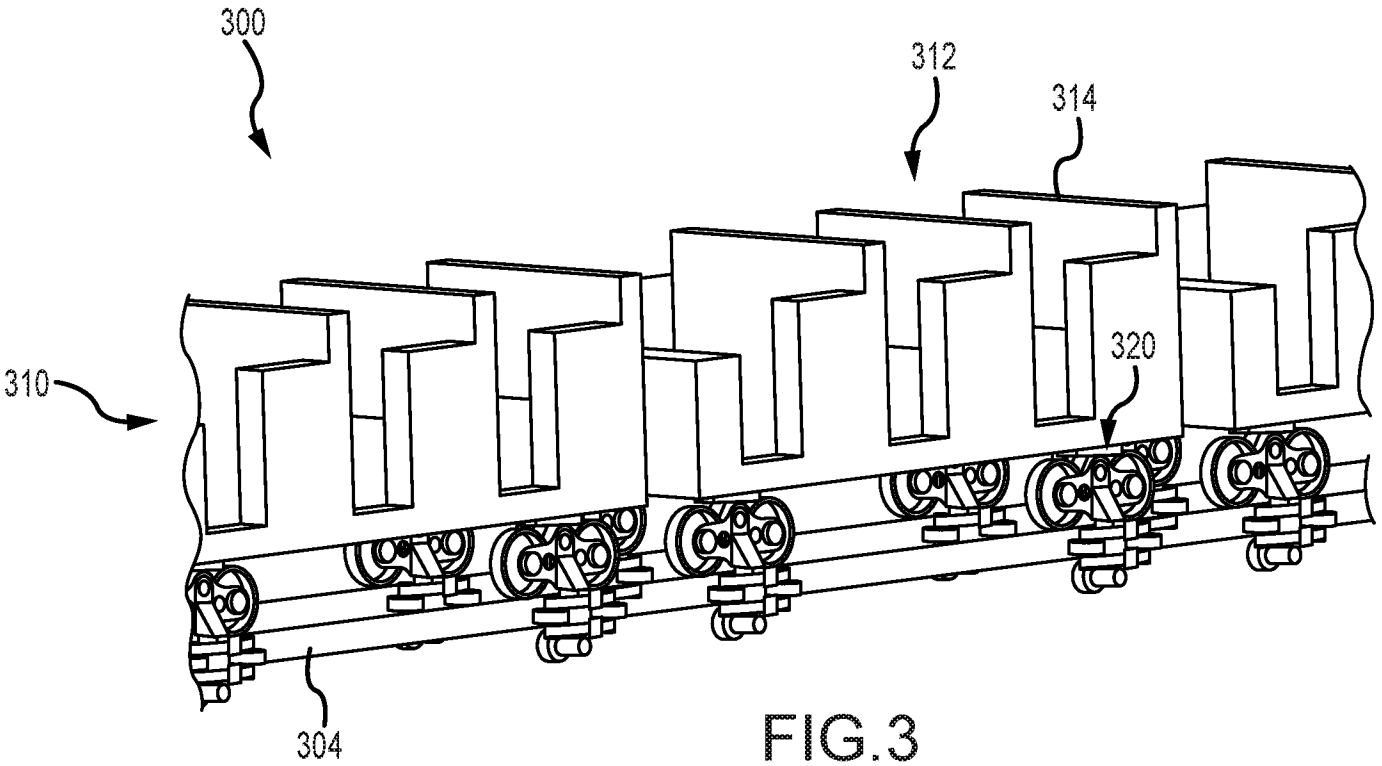
FIG. 3 is a partial perspective view of a park ride (in this non-limiting case, a roller coaster) showing vehicles or cars rollably engaging a track with a set of guidance systems or mechanisms of the present description.

FIG. 3 is a partial perspective view of a park ride 300, which in this non-limiting example is a roller coaster. As shown, the ride 300 includes a train 310 made up of a set of vehicles or cars 312. Each car 312 includes a passenger compartment 314 for seating passengers, and each passenger compartment 314 is coupled to the ride's track 304 (e.g., two spaced shafts with circular cross sectional shapes in this example) to rollably engage the track. To this end, the ride 300 includes a set of four guidance systems or mechanisms of the present description as shown with system 320. As explained below, each guidance system/mechanism 320 is adapted to provide suspension in a direction transverse to the track 304 via shock-absorbing movement of a pair of side guide wheels toward and away from the side of the track 304.

Figure 4:
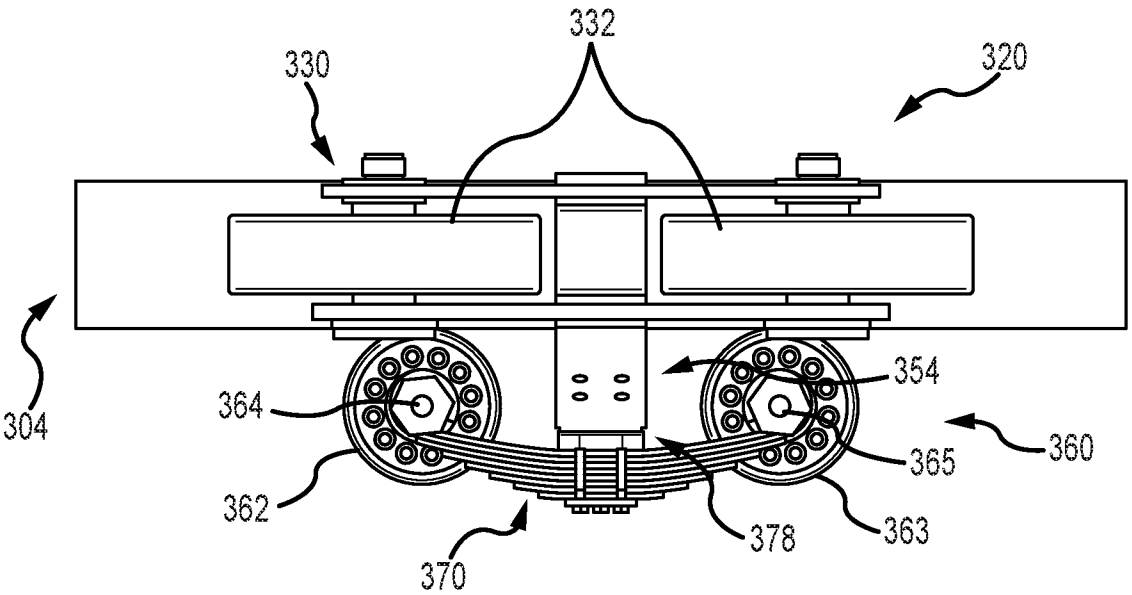
FIG. 4 is a top view of a vehicle guidance mechanism or system of the ride of FIG. 3 showing the new design for a side guide assembly.
Figure 5:
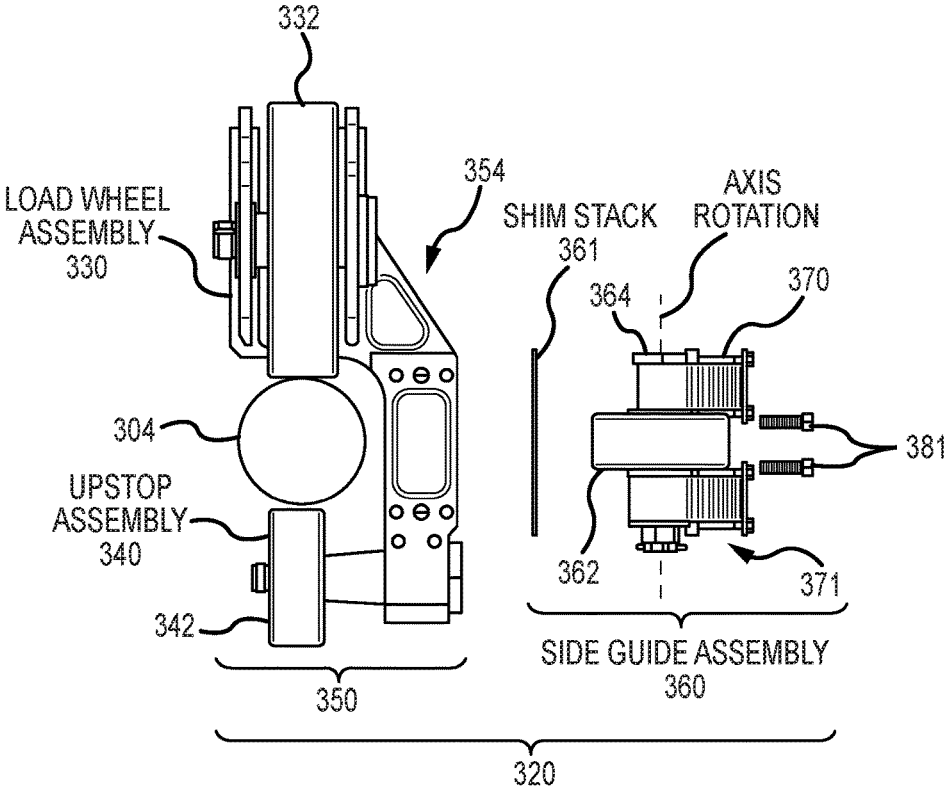
FIG. 5 is a partially exploded side or end view of the vehicle guidance system of FIG. 4 showing additional features of the side guide assembly.
Figure 6:
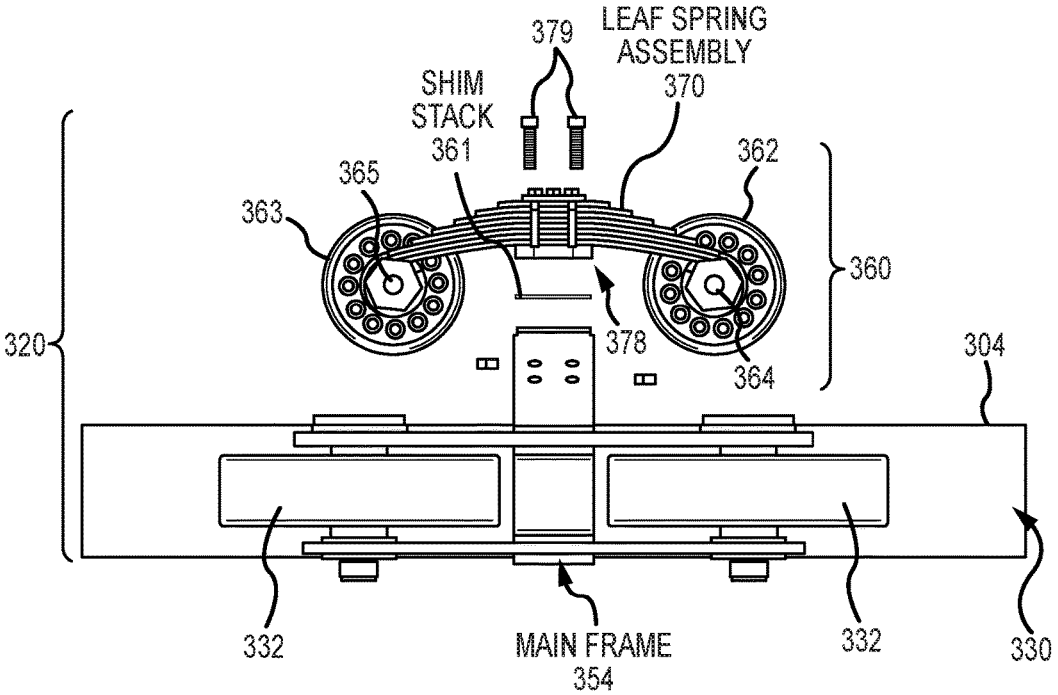
FIG. 6 is a top view of the vehicle guidance system of FIG. 5.

FIG. 4 is a top view of a particular implementation of the vehicle guidance mechanism or system 320 of the ride of FIG. 3 showing the new design for a side guide assembly 360. FIG. 5 is a partially exploded side or end view of the vehicle guidance system 320 of FIG. 4 showing additional features of the side guide assembly 360, and FIG. 6 is a top view of the vehicle guidance system 320 of FIG. 5.

As shown, the vehicle guidance system 320 includes a bogie assembly 350 that may be configured similar to that of traditional designs with a load wheel assembly 330 and an up stop assembly 340 rigidly interconnected with a main support or frame 354. The load wheel assembly 330 includes a pair of load wheels 332 that, when the system 320 is mated with a ride track 304 and attached to a passenger compartment 314 of a ride vehicle 312, ride upon (or roll on) the upper surface of the track 304 during ride operations. The up stop assembly 340 includes an up stop wheel 342 that is positioned with the main support/frame 354 opposite the load wheels 332 to ride on or near the lower surface of the track 304 and limit upward movement of the vehicle 312 to which the system 320 is mounted.

The vehicle guidance system 320 differs from prior guidance mechanisms as it includes a side guide assembly 360 with a new design. In general, the side guide assembly 360 is configured to include one or more spring members, with two leaf springs 370, 371 shown in FIGS. 4-6 but other embodiments may use a single spring member. The spring members function to allow the side guide wheels 362, 363 to move toward and away from the side of the track 304 (transverse movement relative to the longitudinal axis of the track 304) as the vehicle, which includes the system 320 is mounted, rolls over the track 304. To this end, as will be clear, each spring member is configured to support (or provide an anchor point) the rotational shaft/axle of the two side guide wheels 362, 363 at each of its ends (such as with an eye of a leaf spring or the like).

A variety of spring members may be used in the side guide wheel assembly 360 to provide this suspension functionality with the exemplary embodiment shown in FIGS. 4-9 utilizing a pair of leaf springs. The term leaf spring herein is intended to include embodiments with a single spring or leaf (see FIG. 10) as well as those embodiments with a plurality of springs/leafs as shown in FIGS. 4-9. Leaf springs are also referred to as semielliptic springs or cart springs, and leaf springs typically take the form of one or more slender arc-shaped lengths of spring steel (e.g., SAE 1084, 1094, 4063, 4068, 9260, 6150, or the like or another material for such spring applications) of rectangular cross section, and these lengths of spring steel are shaped to provide a tie hole or "eye" at each end. According to the present description, these eyes at each spring member end are used to provide the support or anchor point for the rotation shafts of the side guide wheels 362, 363 (i.e., the rotational axes of the wheels 362, 363 pass through the center of the leaf spring eyes).

As can be seen in FIGS. 4-6, the side guide assembly 360 is mounted to the main support/frame 354 with a mounting plate 378 and a set of fasteners (such as bolts or the like) 379, and the mounting is rigid in that the plate 378 does not move relative to the main support/frame 354 or the bogie assembly 350. The mounting plate 378 is, in turn, coupled to and supports the two spring elements 370, 371 (as shown more clearly below in FIG. 7). A shim or shim stack 361 is sandwiched between the mounting plate 378 and the main support/frame 354 such that the side guide assembly 360 or its mounting position relative to the bogie assembly 350 is adjustable. The shim/stack 361 can be provided in different thicknesses to account for wear and/or preloading of the side guide wheels 362, 363 (e.g., allow for wear of up to 0.25 inches or more), and this adjustment allows the wheels 362, 363 to be utilized without replacement for a longer service life.

As shown, the two spring elements (e.g., leaf springs) 370, 371 are supported on the mounting plate 378 so as to be spaced apart and to be oriented so as to be parallel to each other as well to the longitudinal axis of the track 304. At each end, the spring elements 370, 371 support and provide an anchor point for a pair of rotation shafts 364, 365 for a pair of side guide wheels 362, 363. The wheels 362, 363 each has a rotation axis that extends through one of these shafts 364, 365 and each is supported on the shafts 364, 365 to be able to rotate when the vehicle moves along the track 304 and the wheels 362, 363 contact the side surface of the track 304. In the side guide assembly 360, the side guide wheels 362, 363 are positioned between spring elements 370, 371 (e.g., the two elements 370, 371 are spaced apart a distance that is some amount greater than the width of the wheels 362, 363 and a pair of washers or other spacers/wearing elements may be placed between the wheels 362, 363, and the spring elements 370, 371 as shown).

Figure 7:
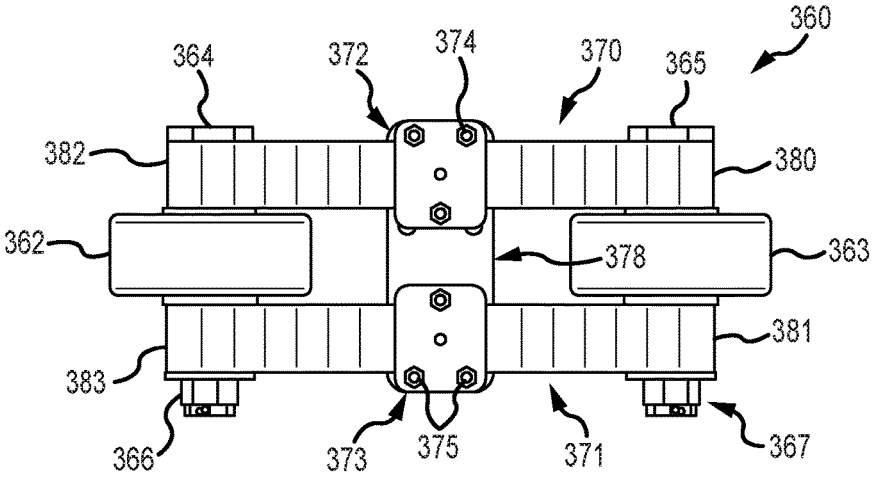
FIG. 7 is a front or plane view of the side guide assembly of the vehicle guidance system of FIGS. 3-6.

FIG. 7 is a front or plane view of the side guide assembly 360 of the vehicle guidance system 320 of FIGS. 3-6. FIG. 7 is useful for showing again that the leaf springs 370, 371 are arranged to be parallel to each other and are spaced apart with the side guide wheels disposed between the springs 370, 371. This configuration is achieved via the mounting plate 378, and the attachment of the spring elements 370, 371 to the mounting plate 378 via front plates 372, 373 and fasteners (or mounting bolts) 374, 375. In this way, the center portions of the spring elements 370, 371 are sandwiched between the plates 372, 373, and 378.

The ends 380, 382 and 381, 383 of the leaf springs 370 and 371 cantilever outward from the center portions and plates 372, 373, 380, and rotation shafts/axles 364, 365 extend through the leaf springs 370, 371, with each shaft 364, 364 kept in place by retaining nuts 366, 367 (and cotter pins or the like). Particularly, first ends 380, 381 of the leaf springs 370, 371 are adapted to support the shaft 365, which in turn supports the side guide wheel 363 such that it can rotate about its rotation axis, and the second ends 382, 383 of the leaf springs 370, 371 are adapted to support the shaft 364, which in turn supports the side guide wheel 362 such that it can rotate about its rotation axis.

Figure 8:
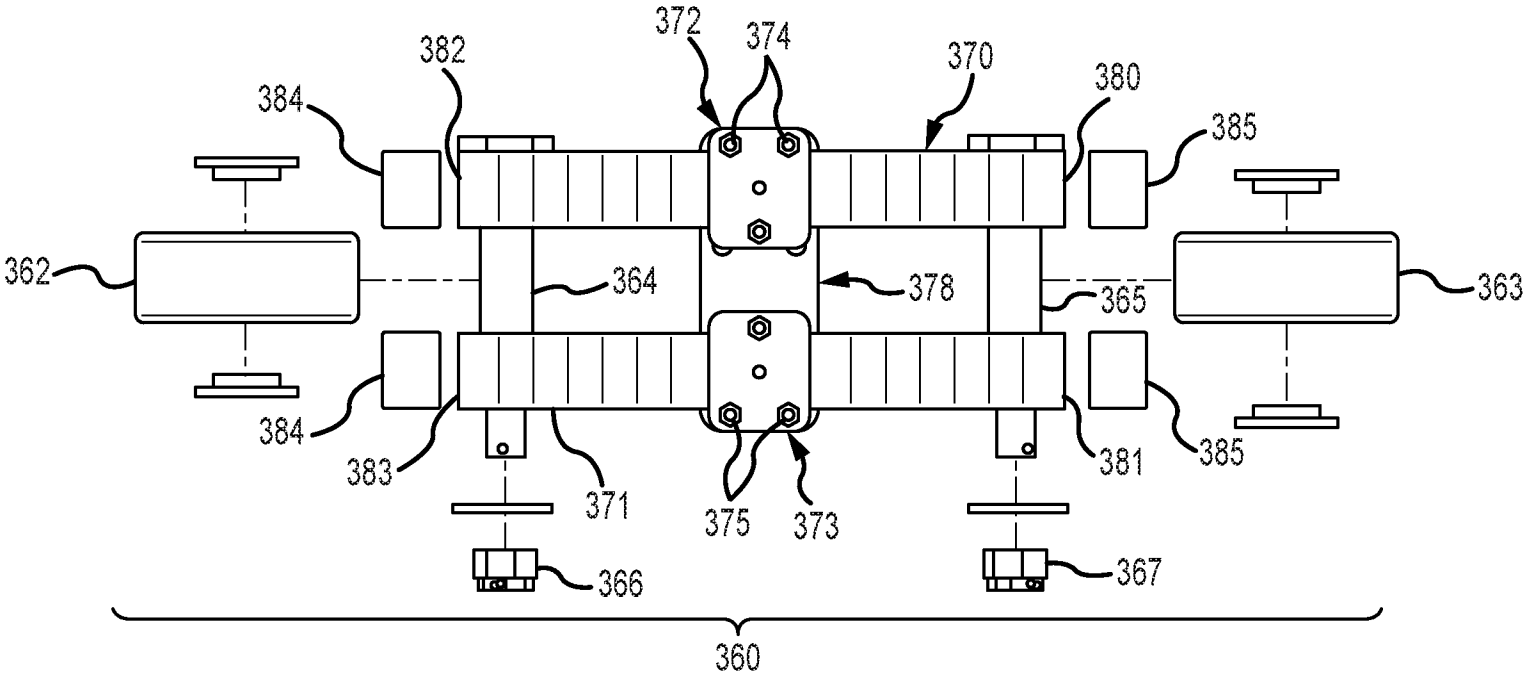
FIG. 8 is an exploded front or plane view of the side guide assembly of FIG. 7.

FIG. 8 is an exploded front or plane view of the side guide assembly 360 of FIG. 7 showing further details of its components and how they are assembled together. As shown, a pair of bushings 384 and 385 is fit onto the rotation shafts 364 and 365, respectively. The bushings 384, 385 are located at the support or anchor point of each of the spring ends 380, 381, 382, 383 so as to be sandwiched between the shafts 364, 365 and the springs 370, 371. FIG. 8 also shows more clearly that pairs of spacers may be provided on the shafts 364, 365 to ride between the spring ends 380, 381, 382, 383 and the hubs of the side guide wheels 362, 363.

Figure 9:
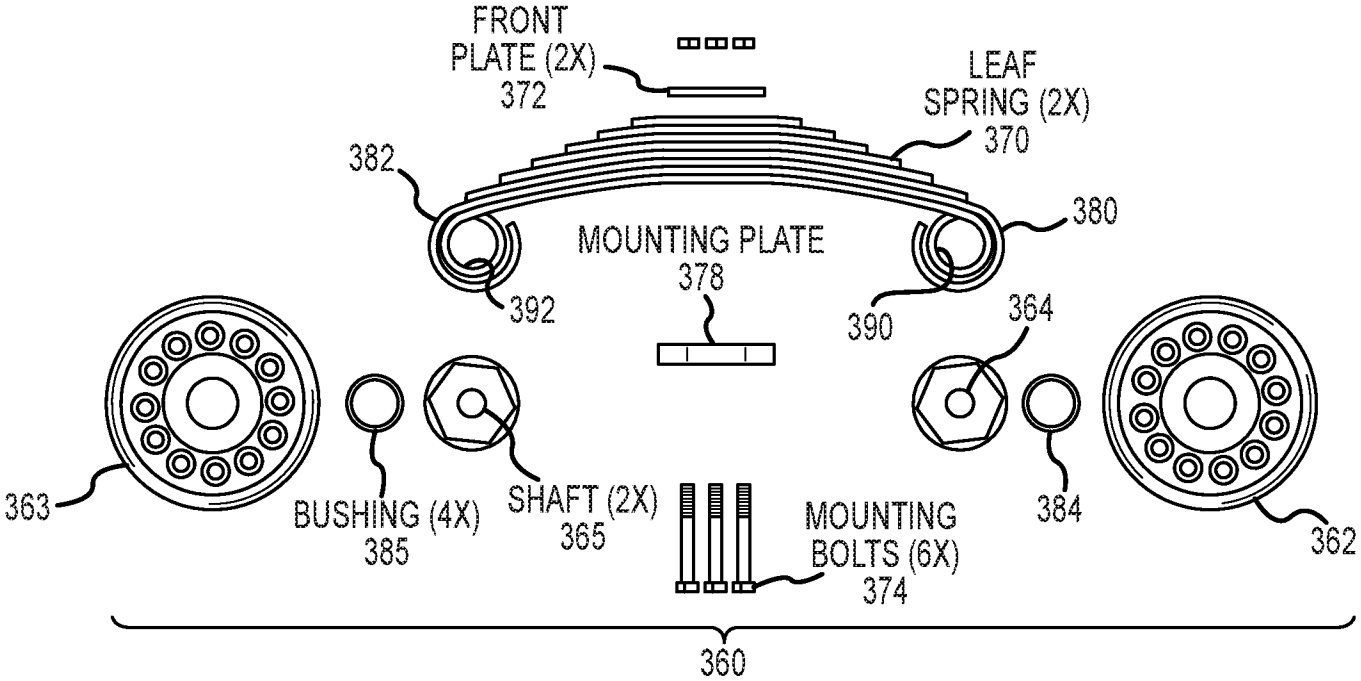
FIG. 9 is a top view, similar to FIG. 6, of the side guide assembly of FIG. 8.

FIG. 9 is a top view, similar to FIG. 6, of the side guide assembly 360 of FIG. 8. FIG. 9 is useful for showing the unique manner in which leaf springs are used to support the side guide wheels 362, 363 while simultaneously providing the suspension function for the assembly 360. As shown for spring 370 (which would be true for spring 371, too), the elongated leaf spring 370 includes a first end 380 and a second end 382 opposite the first send 380. Each end 380, 382 is configured with an eye or tie hole 390, 392 that extends orthogonally through the body of the leaf spring 370, and the eye or tie hole 390, 392 may be formed with one, two, or more of the springs or leafs of the leaf spring 370, with two springs/leafs used in the exemplary, but not limiting embodiment, shown in FIG. 9.

The rotation shafts 364, 365 (with optional bushings 384, 385) are located in the side guide assembly 360 so as to have their longitudinal axes generally coincide with the center points of the tie holes or eyes 390, 392 in the ends 380, 382 of the leaf spring 370 (and also through similar holes/eyes in adjacent leaf spring 371). When in use on a ride vehicle, forces applied to the guide wheels 362, 363, which are supported for rotation on shafts 364, 365, are directly transferred to the material of the springs/leafs in the ends 380, 382 that form the tie holes/eyes 390, 392, and then to the other leafs/springs of the leaf spring 370 (and spring 371). Hence, it can be seen that the use of the spring elements 370, 371 of the side guide assembly 360 to provide supports/anchor points for the rotation shafts 364, 365 is effective in reducing complexity and the number of components, which reduces manufacturing and maintenance costs.

Figure 10:
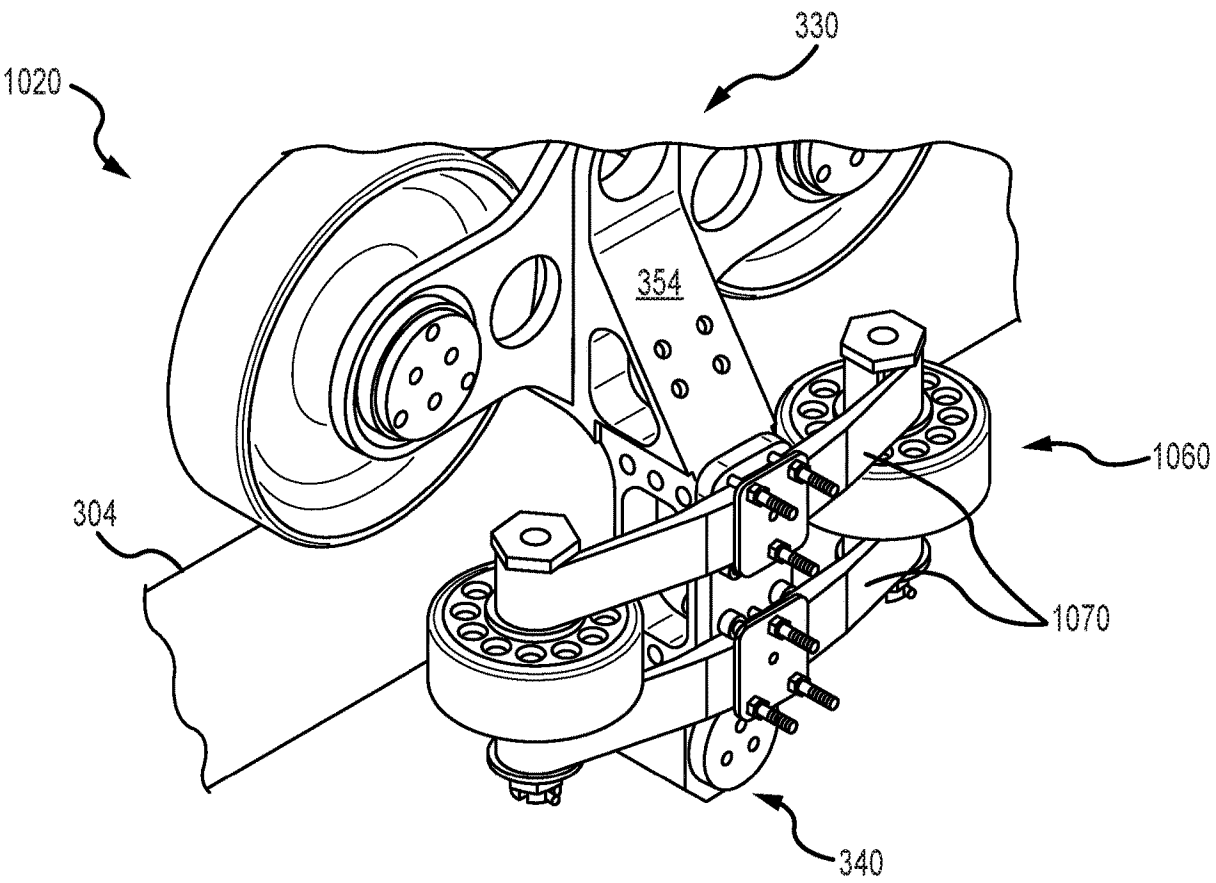
FIG. 10 is a detailed perspective view similar to that of FIG. 3 showing another embodiment of a guidance system with a side guide assembly utilizing a leaf spring with a single spring (or single "leaf") rather than the plurality of springs shown in FIGS. 3-9.

When leaf springs are used for the spring elements (such as for elements 370, 371 in assembly 360), the number of springs or leafs included may vary. FIGS. 4-9 show leaf springs 370, 371 that each includes eight spring members/leafs, but leaf springs with a smaller or larger number of spring members/leafs may be utilized to achieve a desired spring or suspension effect (e.g., a particular spring force (lbs/in) rating for a particular size of the spring elements 370, 371). For example, a leaf spring with a single spring or leaf may be used as shown in FIG. 10. FIG. 10 is a detailed perspective view similar to that of FIG. 3 showing another embodiment of a guidance system 1020 with a top guide assembly 330 and an up stop assembly 340 combined with a side guide assembly 1060. The side guide assembly 1060 utilizes a pair of spring members 1070 each taking the form of a leaf spring including a single spring (or single "leaf") rather than the plurality of springs/leafs shown in FIGS. 3-9.

Although the invention has been described and illustrated with a certain degree of particularity, it is understood that the present disclosure has been made only by way of example, and that numerous changes in the combination and arrangement of parts can be resorted to by those skilled in the art without departing from the spirit and scope of the invention, as hereinafter claimed.

The inventors recognize that many configurations may be used for the components of the new side guide assembly of the present description including use of various materials for the components including the spring elements. Further, the size of the side guide assembly is dependent upon the suspension characteristics that are trying to be achieved. Further, the embodiments shown includes a pair of spring elements, but some embodiments may utilize a single spring element in the form of a leaf spring or other spring design.

However, it may be useful to provide design choices made by the inventors for creating one useful side guide assembly (such as the one shown in FIGS. 3-9). In this exemplary design, the number of leaves/springs in each of the two leaf springs was eight. The eye-to-eye distance was selected to be 13.58 inches while the eye/tie hole inner diameter was in the range of 1 to 1.5 inches (e.g., a 1.378 inch ID bushing was placed in the eye/hole at each end of each leaf spring), and each leaf/spring was 2 inches wide. The material for the leaves was 5160H 42-47 HRC, with a gauge of 0.237 inches. The free arch was 1.68, and the spring rate was 6752 lbs/in for each of the leaf springs.

We claim:

1. An apparatus for guiding a roller coaster along a track with suspension, comprising:
- a load wheel assembly for rollably engaging an upper surface of the track;
- an up stop assembly for contacting a lower surface of the track opposite the upper surface;
- a main support frame coupling the load assembly to the up stop assembly; and
- a side guide assembly rigidly attached to the main support frame, wherein the side guide assembly includes:
  - a pair of side guide wheels for rollably engaging a side surface of the track,
  - a rotation shaft extending through a center of each of the wheels, and
  - an elongated spring element extending from a first end to a second end, wherein the first and second ends each includes an eye receiving and supporting one of the rotation shafts,
- wherein the elongated spring element comprises a leaf spring.

2. The apparatus of claim 1, wherein the side guide assembly further includes a second elongated spring element spaced apart from the elongated spring element and wherein the second elongated spring element includes first and second ends each including an eye receiving and supporting one of the rotation shafts.

3. The apparatus of claim 2, wherein the elongated spring element is parallel to the second elongated spring element.

4. The apparatus of claim 3, wherein longitudinal axes of the rotation shafts are orthogonal to the elongate spring element and the second elongated spring element.

5. The apparatus of claim 1, wherein the eyes are defined by surfaces of ends of at least one leaf of the leaf spring.

6. The apparatus of claim 5, wherein the side guide assembly further includes a bushing inserted into each of the eyes of the leaf spring.

7. The apparatus of claim 1, wherein the leaf spring comprises a plurality of leaves.

8. The apparatus of claim 1, wherein the side guide assembly includes a mounting plate and a set of fasteners for rigidly affixing a center portion of the spring element to the main support frame and wherein the side guide assembly further includes a shim stack of adjustable thickness positioned between the mounting plate and the main support frame.

9. A guidance system for guiding a vehicle on a track, comprising:

a support frame;

a bogie assembly coupled to the support frame and adapted for carrying a vehicle load on the track; and a side guide assembly, coupled to the support frame, including:

first and second side guide wheels, first and second rotation shafts rotatably supporting the first and second side guide wheels, respectively, a first leaf spring, and a second leaf spring spaced apart from the first leaf spring, wherein the first and second leaf springs each includes an eye at each end and wherein the first and second rotation shafts each extends through a pair of the eyes in the first and second leaf springs.

10. The guidance system of claim 9, wherein the first leaf spring is parallel to the second leaf spring.

11. The guidance system of claim 10, wherein the first and second guide wheels are positioned between the first and second leaf springs.

12. The guidance system of claim 9, wherein the first and second leaf springs each includes a single leaf and wherein the eyes are formed by surfaces of the single leaf, whereby the first and second leaf springs directly support the first and second rotation shafts.

13. The guidance system of claim 9, wherein the side guide assembly includes a mounting plate and a set of fasteners for rigidly affixing a center portion of the first and second leaf springs to the support frame and wherein the side guide assembly further includes a shim stack of adjustable thickness positioned between the mounting plate and the main support frame.

14. The guidance system of claim 9, wherein the rotation shafts are parallel to each other and wherein the first and second guide wheels are positioned in contact with a side surface of the track.

15. A roller coaster comprising a vehicle coupled to the track by a plurality of the guidance systems of claim 9.

16. A system for guiding a roller coaster vehicle on a track, comprising:

a support frame;

a load wheel assembly for rollably engaging an upper surface of the track;

an up stop assembly for contacting a lower surface of the track opposite the upper surface, wherein the up stop assembly is coupled with the load wheel assembly by the support frame; and a side guide assembly, coupled to the support frame, including:

first and second side guide wheels, first and second rotation shafts extending through and supporting the first and second side guide wheels, respectively, a first leaf spring comprising a plurality of leafs and with first and second ends each including a tie hole, and a second leaf spring comprising a plurality of leafs and with first and second ends each including a tie hole, wherein the first rotation shaft extends through the tie holes in the first ends of the first and second leaf springs and the second rotation shaft extends through the tie holes in the second ends of the first and second leaf springs, whereby the first and second rotation axes are supported for rotation in the side guide assembly by the first and second leaf springs.

17. The system of claim 16, wherein the first leaf spring is parallel to the second leaf spring and wherein the first and second guide wheels are positioned between the first and second leaf springs.

18. The system of claim 16, wherein the side guide assembly includes a mounting plate and a set of fasteners for rigidly affixing a center portion of the first and second leaf springs to the support frame and wherein the side guide assembly further includes a shim stack of adjustable thickness positioned between the mounting plate and the main support frame.

19. The system of claim 16, wherein the rotation shafts are parallel to each other and wherein the first and second guide wheels are positioned in contact with a side surface of the track.

* * * * *